US005440198A

United States Patent [19]

Oshima et al.

[11] Patent Number: 5,440,198

[45] Date of Patent: Aug. 8, 1995

[54] SPARK PLUG HAVING A NOBLE METAL FIRING TIP BONDED TO A FRONT END OF A CENTER ELECTRODE

[75] Inventors: Takafumi Oshima; Tsutomu Okayama, both of Nagoya, Japan

[73] Assignee: NGK Spark Plug Co., Ltd., Nagoya, Japan

[21] Appl. No.: 70,800

[22] Filed: Jun. 3, 1993

[30] Foreign Application Priority Data

Jun. 17, 1992 [JP] Japan ..... 4-157877

[51] Int. Cl.[6] ..... H01T 21/02

[52] U.S. Cl. ..... 313/141; 313/144; 445/7

[58] Field of Search ..... 313/141, 144; 123/169; 445/7

[56] References Cited

U.S. PATENT DOCUMENTS

| | | | |
|---|---|---|---|
| 4,581,558 | 4/1986 | Takamura et al. . | |
| 4,700,103 | 10/1987 | Yamaguchi et al. | 313/141 |
| 4,803,395 | 2/1989 | Matesco | 445/7 |
| 4,840,594 | 6/1989 | Moore | 313/141 |
| 4,963,112 | 10/1990 | Benedikt et al. . | |
| 5,210,457 | 5/1993 | Oshima et al. | 313/141 |

FOREIGN PATENT DOCUMENTS

| | | |
|---|---|---|
| 1365880 | 5/1964 | France . |
| 3132814 | 4/1982 | Germany . |
| 8901717 | 2/1989 | Germany . |
| 63-57919 | 11/1988 | Japan . |
| 249388 | 2/1990 | Japan . |
| 2500704 | 3/1990 | Japan . |
| 0976798 | 12/1964 | United Kingdom . |

*Primary Examiner*—Sandra L. O'Shea
*Assistant Examiner*—Vip Patel
*Attorney, Agent, or Firm*—Sughrue, Mion, Zinn, Macpeak & Seas; Richard C. Turner; Marie-Claire Boisvert

[57] ABSTRACT

In a spark plug, a nickel-alloyed center electrode has a front end which has a constricted end forming a spark gap with a ground electrode by way of a noble metal firing tip. The noble metal firing tip is secured to a front end surface of the constricted end by applying a laser beam welding to an interface between the constricted end and the firing tip all through their circumferential length so as to form a wedge-shaped welding solidification portion.

4 Claims, 8 Drawing Sheets

SPARK PLUG HAVING A NOBLE METAL FIRING TIP BONDED TO A FRONT END OF A CENTER ELECTRODE

BACKGROUND OF THE INVENTION

1. Field of the Invention

This invention relates to a spark plug for an internal combustion engine in which a noble metal firing tip is secured to a front end of a center electrode.

2. Description of Prior Art

In a center electrode of a spark plug for an internal combustion engine, a composite structure has been used in which a heat-conductive core (Cu) is embedded in a heat-and erosion-resistant clad metal (nickel-based alloy) as shown in Japanese Patent Publication No. 59-2152. According to the Japanese Patent Publication No. 59-2152, a nobel firing tip is further bonded to a front end of the clad metal by means of electric resistance welding so as to improve its spark-erosion resistant property. After completing the electric resistance welding, the firing tip and the front end of the clad metal are milled respectively to make them diametrically even.

In another Japanese Patent Publication No. 63-57919, a hole is provided at a front end surface of the clad metal, and the firing tip is placed within the hole to apply a laser beam welding from the front end of the clad metal to the firing tip.

In the former prior art, the electric resistance welding causes to heat and press the firing tip so as to make the edged corner of the firing tip rounded. As a result, a higher voltage is required for the spark plug to discharge between its electrodes. In order to recover the original edged corner, it is necessary to mill the firing tip only to waste the expensive noble metal.

In the latter prior art, it is necessary at the time of the laser beam welding to place the firing tip deep enough into the hole to positively secure the firing tip against inadvertent removal. This requires an increased quantity of the noble metal to make the firing tip costly.

Therefore, it is one of the objects of the invention to provide a spark plug in which a noble metal firing tip is positively bonded to a front end of a center electrode by means of a laser beam welding without sacrificing a good ignitability with a minimum amount of noble metal, and thus contributing to an extended service life with relatively low cost.

SUMMARY OF THE INVENTION

According to the invention, there is provided a spark plug comprising: a nickel-alloyed center electrode, a front end of which has a constricted end; and a noble metal firing tip which has a same diameter as the constricted end which forms a spark gap with a front end of a ground electrode, the firing tip being secured to a front end surface of the constricted discharge end by applying a laser beam welding to an interface between the constricted end and the firing tip all through their circumferential length so as to form a wedge-shaped welding solidification portion at the interface.

With the noble metal firing tip welded to the front end surface of the constricted end, it is possible to decrease the required spark voltage without sacrificing a good ignitablity with a minimum amount of spark erosion.

According to the invention, there is provided a spark plug wherein a dimensional relationship between D, T, L, A, R and B is as follows: $0.5\ mm \leqq D \leqq 1.5\ mm$, $0.3\ mm \leqq T \leqq 0.6\ mm$, $0.2\ mm \leqq L \leqq 0.5\ mm$, $R/3 \leqq A \leqq R$, $0.3\ mm \leqq B \leqq 0.8\ mm$.

Where (D) is a diameter of the noble metal firing tip, (T) is a thickness of the noble metal firing tip, (L) is a length of constricted end of the center electrode, (A) is a depth of the wedge-shaped welding solidification portion penetrated how far from the outer surface of both the constricted end and the firing tip, (R) is a radius of the noble metal firing tip, and (B) is a width of the wedge-shaped welding solidification portion measured at an outer surface of both the constricted end and the firing tip.

With the dimensional relationship defined concretely as above, it is possible to decrease the required spark voltage with a smaller amount of the noble metal, and ensuring a good ignitablity with a minimum amount of spark erosion.

According further to the invention, there is provided a spark plug wherein the laser beam welding is applied intermittently to the outer surface of both the constricted end and the firing tip in order to partially overlap neighboring shot spots of the laser beam welding, each front end limit of the shot spots being away from a front end surface of the firing tip by at least 0.1 mm.

With the neighboring shot spots partially overlapped and the front end limit of the shot spots being away from a front end surface of the firing tip by at least 0.1 mm, it is possible to positively maintain the firing tip secured to the front end of the center electrode without falling off the center electrode inadvertently at the time of the spark discharging in which the spark plug undergoes the high pressure and highly heated environment. With the edged corner of the firing tip remaining intact, it is possible for the spark plug to discharge with a minimum voltage.

According furthermore to the invention, there is provided a spark plug wherein the center electrode comprises a heat-resistant clad metal and a heat-conductive core embedded in the clad metal, a front end of the heat-conductive core is either thermally transferable contact with a rear end surface of the firing tip or away from the rear end surface of the firing tip within a range of 1.5 mm.

With the above structure, the heat is preferably transferred from the firing tip to the heat-conductive core to prevent the temperature of the firing tip from excessively rising. This makes it possible to reduce the voltage required to discharge between the electrodes with a minimum amount of the spark erosion even when a thinner firing tip is used.

These and other objects and advantages of the invention will be apparent upon reference to the following specification, attendant claims and drawings.

DETAILED DESCRIPTION OF THE EMBODIMENTS

Figure 1:
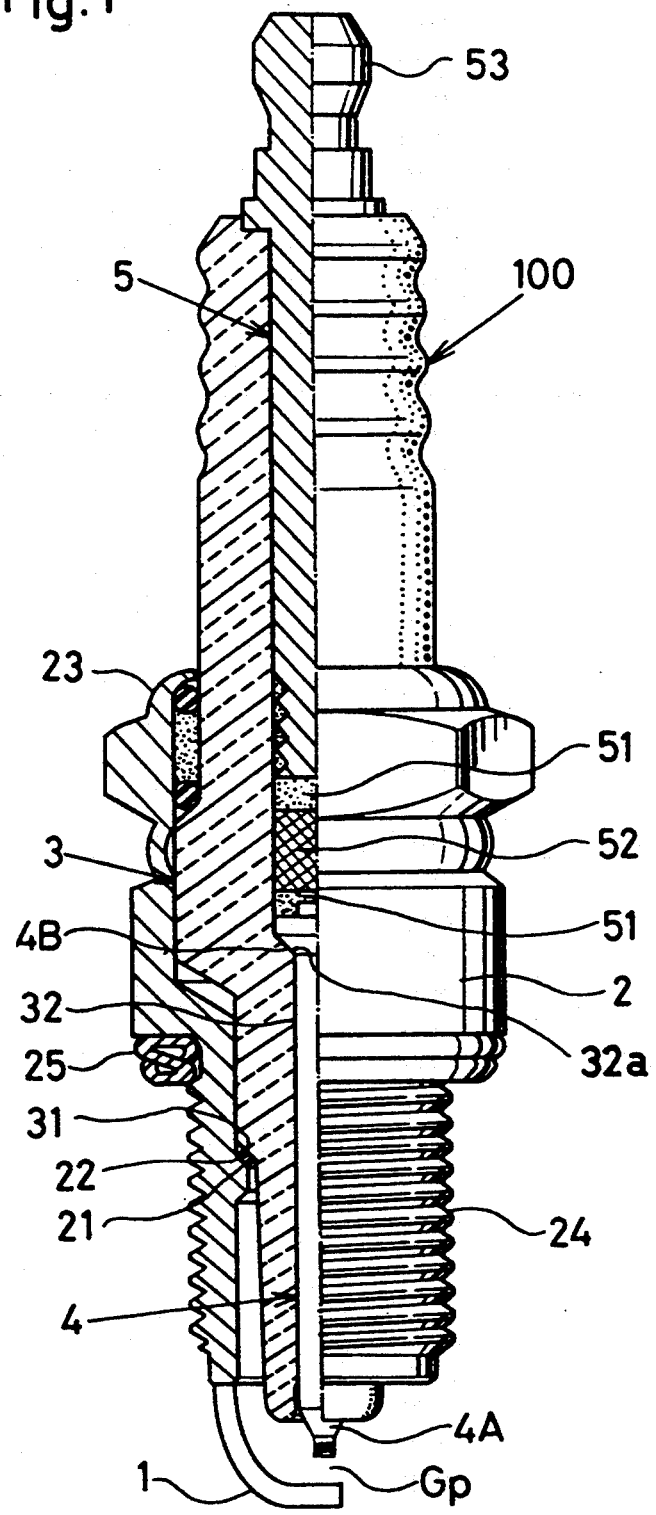
FIG. 1 is a plan view of a spark plug, but its left half is sectioned.

Referring to FIG. 1 which shows a spark plug 100 according to the invention, the spark plug 100 has a cylindrical metallic shell 2 whose front end has a ground electrode 1 by means of welding. An inner wall of the metallic shell 2 has a shoulder portion 21, while a rear end of the metallic shell 2 has a thin head 23. Within the metallic shell 2, a tubular insulator 3 is concentrically supported by resting a stepped portion 31 of the insulator 3 on the shoulder portion 21 by way of a packing 22. The thin head 23 is inturned by means of caulking to secure the insulator 3 against removal. An inner space of the insulator 3 serves as an axial bore 32 in which a center electrode 4 is placed by engaging a flange 4B against a shoulder seat 32*a* provided at an inner wall of the insulator 3. The front end of the center electrode 4 has a constricted end 4A which extends slightly beyond the insulator 3 to form a spark gap (Gp) with the ground electrode 1 through a firing tip described hereinafter. To a rear end of the center electrode 4, is a middle axis 5 connected which has an electrically conductive glass sealant 51, a monolithic resistor 52 and a terminal 53. The spark plug 100 thus structured is secured to a cylinder head of the internal combustion engine (not shown) by way of a gasket 25 and a threaded portion 24 provided at the metallic shell 2.

Figure 2:
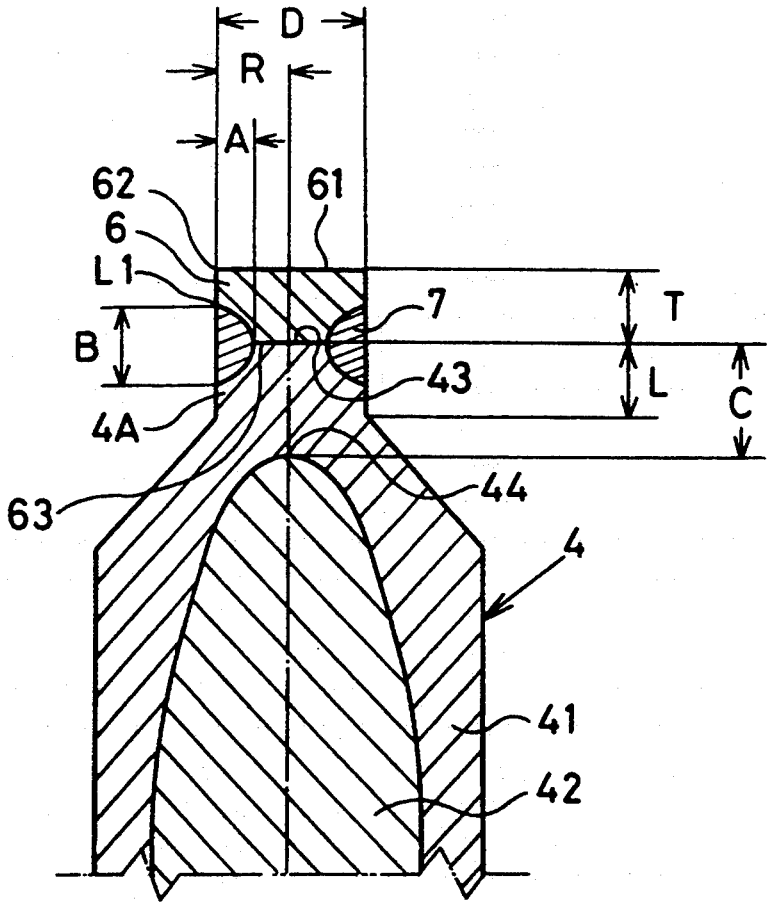
FIG. 2 is a longitudinal cross sectional view of a front portion of a center electrode.

The center electrode 4 has a clad metal 41 and a heat-conductive core 42 embedded in the clad metal 41 as shown in FIG. 2. The clad metal 41 is made of Inconel 600 including iron (Fe) and chromium (Cr), while the heat-conductive core 42 made of a alloyed metal with a copper (Cu) or silver (Ag) as a main component. To a front end surface of 43 of the constricted end 4A, a noble metal firing tip 6 is bonded by way of a laser beam welding. A diameter of the firing tip 6 is the same as the constricted end 4A, and made of platinum (Pt), iridium (Ir), Pt-Ir alloy or iridium-based alloy including oxides of rare earth metals. In this instance, a front end 44 of the heat-conductive core 42 is either thermally transferable contact with a rear end 63 of the firing tip 6 or away from the rear end 63 within the range of 1.5 mm.

The laser beam welding is carried out by using YAG (yttrium, aluminum and garnet) laser beams (Lb) with one shot energy as 2 Joules.

Figure 3:
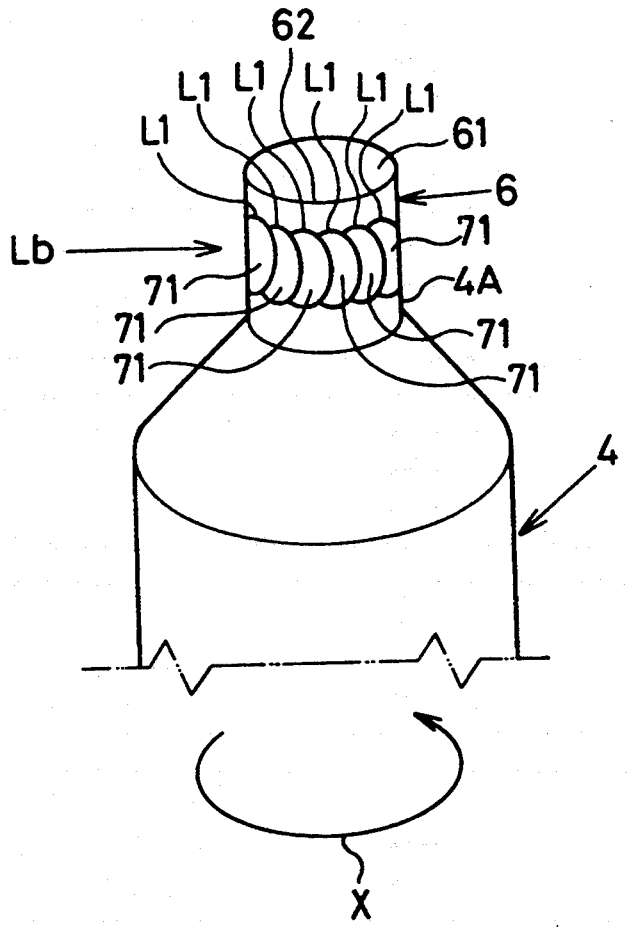
FIG. 3 is a perspective view of the front portion of the center electrode.

The laser beams (Lb) are applied intermittently to a circumferential interface between a front end surface 43 of the constricted end 4A and a rear end 63 of the firing tip 6 as understood by comparing FIG. 2 to FIG. 3. In this instance, the laser beams (Lb) are directed in parallel with an interface plane between the constricted end 4A and the firing tip 6. As shown at an arrowed circle (X) in FIG. 3, the laser beams (Lb) are shot sufficient times all through their circumferential length to at least partially overlap neighboring shot spots 71 of the welded portion. Then, the laser beams (Lb) causes to form a wedge-shaped welding solidification alloy portion 7 in which the clad metal 41 and the firing tip 6 are fused each other.

In this instance, it is necessary that each front end limit (L1) of the shot spots 71 is away from a front end surface 61 of the firing tip 6 by at least 0.1 min. This is because an edged corner 62 of the firing tip 6 is rounded by the heat of the laser beams so as to require an increased spark voltage when the each front end limit (L1) of the shot spots 71 extends to the front end surface 61 of the firing tip 6 beyond the limit of 0.1 mm.

The welding solidification alloy portion 7 is such that it has an intermediate physical property (e.g. thermal expansional coefficient) between the clad metal 41 and the firing tip 6. This makes it difficult for the firing tip to fall off the clad metal 41 due to the thermal expansional difference between the clad metal 41 and the firing tip 6 when the front end of center electrode 4 is exposed to a high temperature environment.

A dimensional relationship between D, T, L, A, R and B is as follows:

$0.5\ \text{mm} \leqq D \leqq 1.5\ \text{mm}$, $0.3\ \text{mm} \leqq T \leqq 0.6\ \text{mm}$, $0.2\ \text{mm} \leqq L \leqq 0.5\ \text{mm}$, $R/3 \leqq A \leqq R$, and $0.3\ \text{mm} \leqq B \leqq 0.8\ \text{mm}$.

Where (D) is a diameter of the noble metal firing tip 6, (T) is a thickness of the noble metal firing tip 6, (L) is a length of the constricted end 4A of the center electrode 4, (A) is a depth of the welding solidification alloy portion 7 penetrated how far from the outer surface of both the constricted end 4A and the noble metal firing tip 6, (R) is a radius of the noble metal firing tip 6, and (B) is a width of the welding solidification alloy portion 7 measured at the outer surface both the constricted end 4A and the noble metal firing tip 6.

Figure 4:
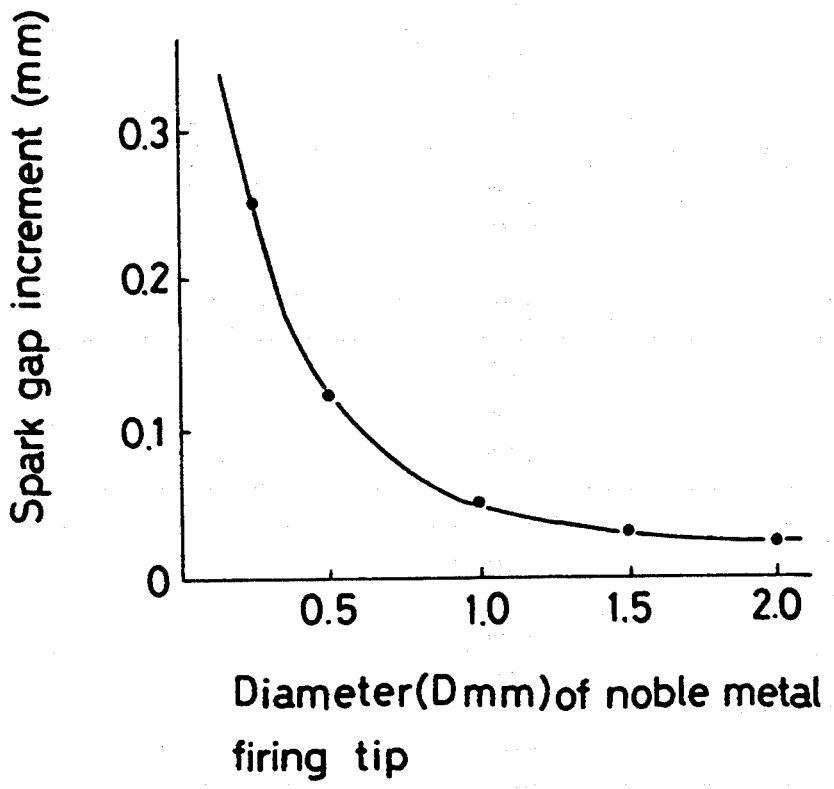
FIG. 4 is a graph showing a relationship between a diameter of a noble metal firing tip and a spark gap increment.

The reason when the formula $0.5\ \text{mm} \leqq D \leqq 1.5\ \text{mm}$ is determined is as follows:

FIG. 4 shows a graph how the spark gap changes depending on the diameter (D) of the firing tip 6. The graph is obtained after carrying out an endurance experiment test at full throttle (5000 rpm) for 300 Hrs with the spark plug 100 mounted on an internal combustion engine (six-cylinder, 2000 cc).

As apparent from FIG. 4, the spark discharge concentrates on the firing tip 6 to rapidly increase the spark gap when the diameter (D) of the firing tip 6 is less than 0.5 mm. That is to say, the diameter (D) less than 0.5 mm promptly develops the spark erosion of the firing tip 6 although the voltage required for the spark plug to discharge is reduced with the decrease of the diamter (D).

Meanwhile, the diameter (D) exceeding 1.5 mm causes to worsen the ignitablity by the increased surface area of the firing tip 6, and at the same time, increasing the amount of the noble metal to make it costly.

Figure 5:
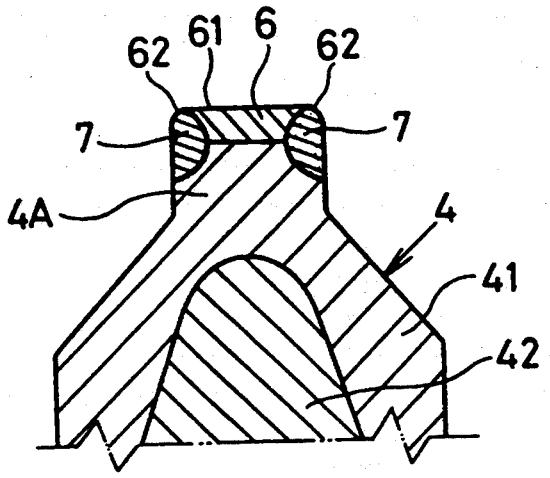
FIG. 5 is a longitudinal cross sectional view of the front portion of the center electrode when a thickness of the firing tip is less than 0.3 mm.

The reason why the thickness (T) of the firing tip 6 is more than 0.3 mm is as follows:

When the thickness (T) is less than 0.3 mm, the edged corner 62 of the firing tip 6 is rounded at the time of applying the laser beam welding so as to increase the voltage required for the spark plug to discharge as shown in FIG. 5.

The reason why the thickness (T) of the firing tip 6 is less than 0.6 mm is that the amount of the noble metal not involved in the spark-erosion resistance increases to make it costly when the thickness (T) exceeds 0.6 mm.

When the length (L) of the constricted end 4A is less than 0.2 mm, the heat of the laser beam welding is partially drawn from the clad metal 41 to the heat-conductive core 42. This makes it difficult to evenly fuse the interface between the firing tip 6 and the constricted end 4A.

When the length (L) of the constricted end 4A exceeds 0.5 mm, the clad metal 41 is exposed to an increased amount of the laser beam heat so as to develop blowholes or cracks in the clad metal 41 at the time of carrying out the laser beam welding particularly because the clad metal 41 has a melting point smaller than the firing tip 6.

Figure 6:
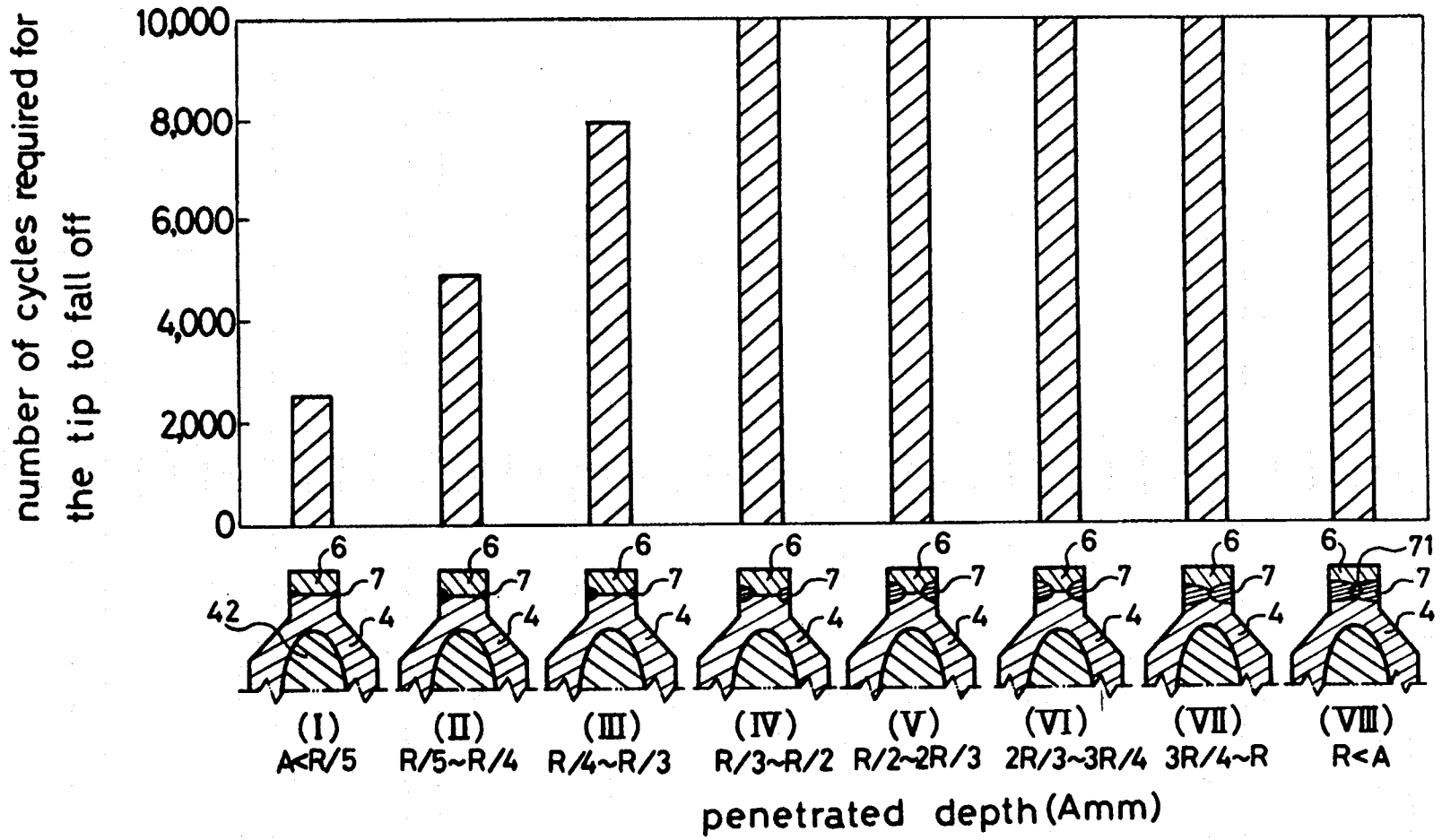
FIG. 6 is a graph showing a relationship between a penetrated depth (A) of a welding solidification portion and number of operating cycles required for the firing tip to fall off the center electrode.

The reason why the formula $R/3 \leqq A \leqq R$ is obtained is as follows:

FIG. 6 is a graph showing a relationship between the penetrated depth (A) of the welding solidification alloy portion 7 and a repeated number of endurance cycles required to fall the firing tip 6 off the constricted end 4A. The graph is obtained after carrying out the endurance cycles alternately between a full throttle (5000 rpm) for 1 min. and an idle operation for 1 min. with the spark plug 100 mounted on an internal combustion engine (six-cylinder, 2000 cc).

In this instance, the relationship of the depth (A) and the radius (R) is classified into eight cases.

These are $A<R/5$ (I), $A=R/5\sim R/4$ (I), $A=R/4\sim R/3$ (III), $A=R/3\sim R/2$ (IV), $A=R/2\sim R/3$ (V), $A=2R/3\sim 3R/4$ (VI), $A=3R/4\sim R$ (VII) and $A>R$ (VIII).

As apparent from FIG. 4, the firing tip 6 does not fall off the constricted end 4A even when exposed to 1000 times of the repeated number of endurance cycles upon determining the relationship as $A=R/3\sim R/2$ (IV).

In the case of (VIII), it is not desirable to determine as $A>R$ since it is found that blowholes occurs on which the neighboring shot spots 71 overlap although the firing tip 6 does not fall off the constricted end 4A.

The reason why the width (B) of the welding solidification alloy portion 7 is determined as more than 0.3 mm is as follows:

When the width (B) is less than 0.3 mm, a shortage of the laser beams (Lb) fails to satisfy that the penetrated depth (A) is more than 1/5 of the diameter (D) of the firing tip 6. This causes to fall the firing tip 6 off the clad metal 41.

When the width (B) exceeds 0.8 mm, the firing tip 6 is exposed to an increased amount of the laser beam heat so as to melt the edged corner 62 of the firing tip 6. Otherwise, the increased amount of the laser beam heat develops blowholes or cracks in the clad metal 41 at the time of carrying out the laser beam welding particularly because the clad metal 41 has a melting point smaller than the firing tip 6. It is appreciated that the width (B) falls preferably within the range from 0.4 mm to 0.5 mm.

The following is a reason why the front end 44 of the heat-conductive core 42 is either thermally transferable contact with the rear end 63 of the firing tip 6 or away from the rear end 63 within the range of 1.5 mm.

Figure 7:
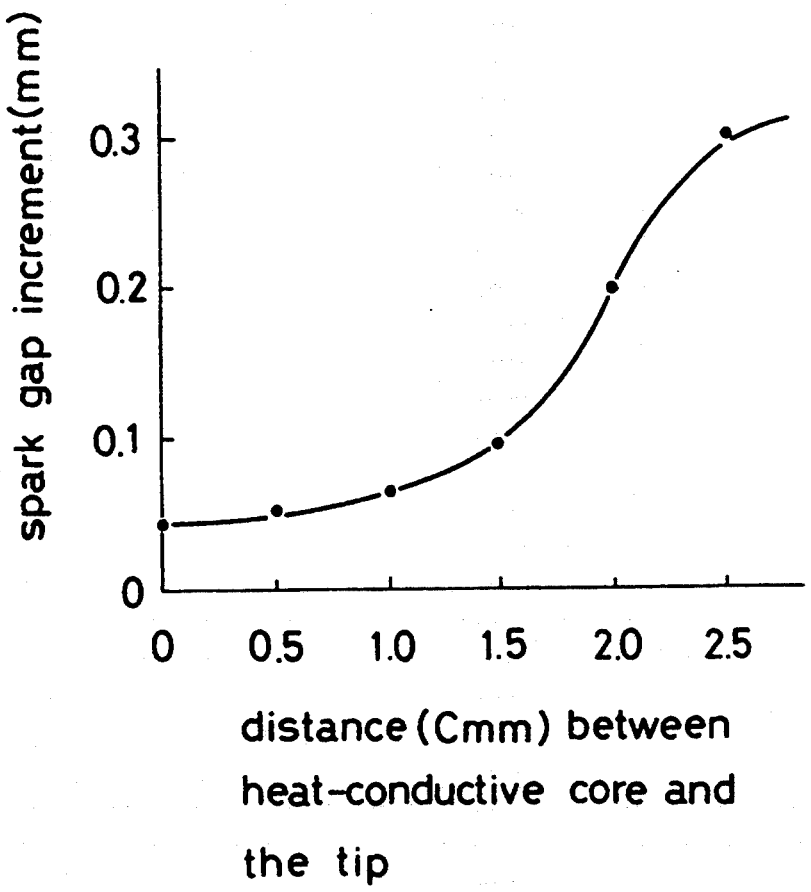
FIG. 7 is a graph showing a relationship between a spark gap increment and a distance from the firing tip to a heat-conductive core.

FIG. 7 shows a graph how the spark gap changes depending on a distance (C) between the front end 44 of the core 42 and the rear end 63 of the firing tip 6 as denoted in FIG. 2. The graph is obtained after carrying out an endurance experiment test at full throttle (5000 rpm) for 300 Hrs with the spark plug 100 mounted on an internal combustion engine (six-cylinder, 2000 cc).

As apparent from FIG. 7, the distance (C) exceeding 1.5 mm rapidly increases the spark gap. This is because the firing tip 6 undergoes a considerable amount of the corrosion or erosion due to the shortage of effectively drawing the heat from the firing tip 6 to the heat-conductive core 42.

FIGS. 8~11 show modification forms of the embodiment of the invention.

Figure 8:
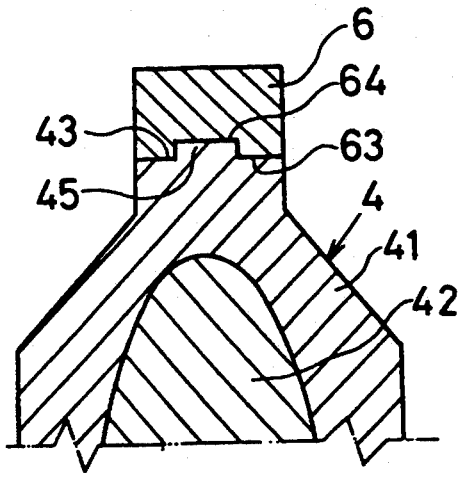
FIG. 8 is a view similar to FIG. 2 according to a first modification form of the embodiment of the invention.

In a first modification form in FIG. 8, the front end surface 43 of the constricted end 4A has a projection head 45 interfit into a recess 64 provided with the rear end 63 of the firing tip 6. This enables to obviate the necessity of provisionally holing the firing tip in place at the time of applying the laser beam welding.

Figure 9:
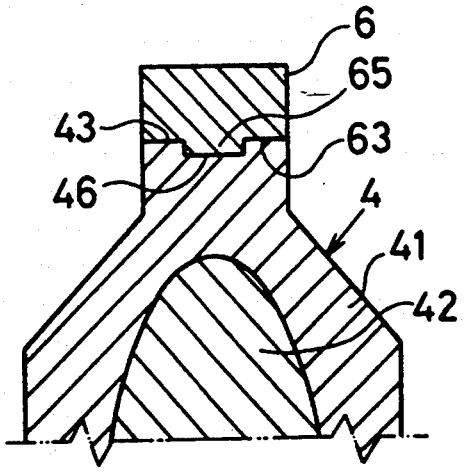
FIG. 9 is a view similar to FIG. 2 according to a second modification form of the embodiment of the invention.

In a second modification form in FIG. 9, the front end surface 43 of the constricted end 4A has a recess 46 into which a projection head 65 is interfit which is provided with the rear end 63 of the firing tip 6. The projection head 65 comes near to the core 42 so that it enables to readily draw the heat from the firing tip 6 to the heat-conductive core 42 at the time of applying the laser beam welding.

Figure 10:
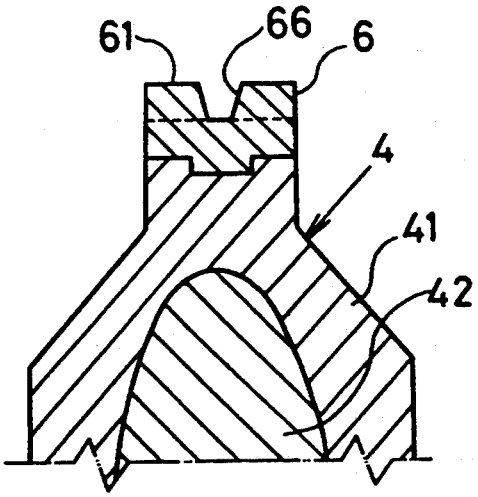
FIG. 10 is a view similar to FIG. 2 according to a third modification form of the embodiment of the invention.

In a third modification form in FIG. 10, a cruciform groove 66 is provided on the front end surface 61 of the firing tip 6. This makes it possible to virtually increase the spherical volume between the front end surface 61 and the ground electrode, and thus preventing the spark discharge from inadvertently extinguishing so as to reduce the variation of the discharge voltage with a good ignitability.

Figure 11:
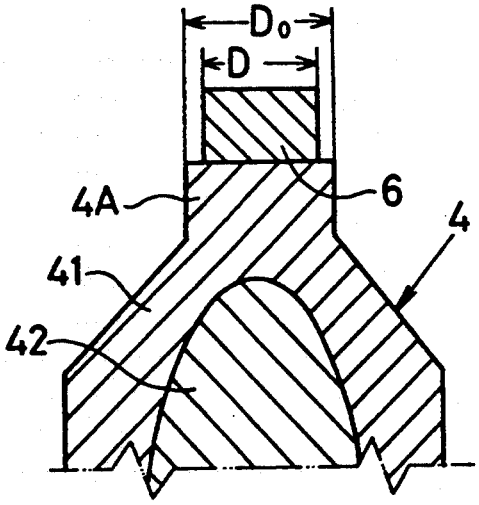
FIG. 11 is a view similar to FIG. 2 according to a fourth modification form of the embodiment of the invention.

In a fourth modification form in FIG. 11, the diameter (D) of the firing tip 6 is smaller than a diameter (Do) of the constricted end 4A. The laser beam welding is applied to an interface between the firing tip 6 and the constricted end 4A all through their circumferential length. This enables to reduce an amount of the noble metal to make it advantageous from the cost-saving viewpoint.

It is noted that an argon welding and electron beam welding may be used instead of the laser beam welding.

It is also noted that the ground electrode may be made in integral with the metallic shell instead of welding it to the metallic shell.

Further, it is appreciated that the ground electrode may be made of a composite column in which a copper core is embedded in a clad metal in the same manner as the center electrode 4 assembled in the embodiment of the invention.

While the invention has been described with reference to the specific embodiments, it is understood that this description is not to be construed in a limiting sense in as much as various modifications and additions to the specific embodiments may be made by skilled artisan without departing from the spirit and scope of the invention.

What is claimed is:

1. A spark plug comprising:

a nickel-alloyed center electrode having a front end arranged as a constricted end, said front end comprising a front end surface without a recess; and a noble metal firing tip having a surface at one end bonded to said front end surface of said constricted end by laser beam welding at an interface between said constricted end and said noble metal firing tip for an entire circumferential length of each of said constricted end and said noble metal firing tip, wherein said noble metal firing tip has a same diameter as said constricted end and forms a spark gap with a ground electrode, and wherein a wedge-shaped welding solidification portion is formed at said interface;

wherein a dimensional relationship between D, T, L, A, R and B is as follows:

$0.5\ mm \leqq D \leqq 1.5\ mm$, $0.3\ mm \leqq T \leqq 0.6\ mm$, $0.2\ mm \leqq L \leqq 0.5\ mm$, $R/3 \leqq A \leqq R$, $0.3\ mm \leqq B \leqq 0.8\ mm$, wherein (D) is a diameter of said noble metal firing tip, (T) is a thickness of said noble metal firing tip, (L) is a length of said constricted end of said center electrode, (A) is a depth of said wedge-shaped welding solidification portion penetrated from an outer surface of both said constricted end and noble metal firing tip, (R) is a radius of said noble metal firing tip, and (B) is a width of said wedge-shaped welding solidification portion measured at said outer surface of both said constricted end and said noble metal firing tip.

2. A spark plug as recited in claim 1, wherein said laser beam welding is applied intermittently to an outer surface of both said constricted end and said noble metal firing tip in order to partially overlap neighboring shot spots of said welding solidification portion, each front end limit of the shot spots being away from a front end surface of said noble metal firing tip by at least 0.1 mm.

3. A spark plug as recited in claim 1, wherein said center electrode comprises a heat-resistant clad metal and a heat-conductive core embedded in said heat-resistant clad metal, a front end of said heat-conductive core being in one of thermally transferable contact with a rear end surface of said noble metal firing tip and away from said rear end surface of said noble metal firing tip within a range of 1.5 mm.

4. A spark plug as recited in claim 2, wherein said center electrode comprises a heat-resistant clad metal and a heat-conductive core embedded in said heat-resistant clad metal, a front end of said heat-conductive core being in one of thermally transferable contact with a rear end surface of said noble metal firing tip and away from said rear end surface of said noble metal firing tip within a range of 1.5 mm.

* * * * *